United States Patent [19]

Piorunneck

[11] Patent Number: 5,024,609

[45] Date of Patent: Jun. 18, 1991

[54] HIGH-DENSITY BI-LEVEL CARD EDGE CONNECTOR AND METHOD OF MAKING THE SAME

[75] Inventor: Heinz Piorunneck, Trumbull, Conn.

[73] Assignee: Burndy Corporation, Norwalk, Conn.

[21] Appl. No.: 504,762

[22] Filed: Apr. 4, 1990

[51] Int. Cl.[5] ..... H01R 13/00

[52] U.S. Cl. ..... 439/637; 439/924

[58] Field of Search ..... 439/629-637, 439/924

[56] References Cited

U.S. PATENT DOCUMENTS

| | | | |
|---|---|---|---|
| 3,601,770 | 8/1971 | Bowley | 439/629 |
| 3,973,817 | 8/1976 | Stalley et al. | 439/924 |
| 4,146,291 | 3/1979 | Goff et al. | 439/924 |
| 4,550,959 | 11/1985 | Grabbe et al. | 439/630 |
| 4,734,041 | 3/1988 | Bruchmann et al. | 439/924 |

*Primary Examiner*—Joseph H. McGlynn

*Attorney, Agent, or Firm*—Perman & Green

[57] ABSTRACT

An electrical connector of the card edge connector type having a housing, two types of contacts and a contact separator. At least two contacts are located in the same contact chamber in the housing with the separator keeping the contacts separate. In an alternate embodiment, the connector has two housings. Each housing has a contact therein and one housing is mounted inside the other housing. The connector can also comprise a signal transmitting section and a power transmitting section formed from modular units that are connected together at their ends.

24 Claims, 4 Drawing Sheets

HIGH-DENSITY BI-LEVEL CARD EDGE CONNECTOR AND METHOD OF MAKING THE SAME

BACKGROUND OF THE INVENTION

1. Field of the Invention

This invention relates to electrical connectors and, more particularly, to bi-level card edge connectors and a method of manufacturing the same.

2. Prior Art

In electrical arts it is a common practice to use a connector to mechanically and electrically couple a mother printed circuit board with a daughter printed circuit board as of the vertical edge card variety. In such a practice, there has been an evolution towards placing electrical contacts closer and closer together while maintaining a high, constant stress between the electrical contacts and the areas to be contacted. In placing the contacts closer together, as to 20 contacts per linear inch, the width of each contact must decrease. One such connector is found in U.S. Pat. No. 4,846,734, entitled "Vertical Edge Card Connectors" by Thomas G. Lytle which is assigned to the same assigned as herein and is incorporated by reference in its entirety herein.

There has also been developed a special type of connector which is known in the art as a bi-level connector; i.e.: a connector having two types of contacts that make contact with a daughter printed circuit board in two locations or at two levels. The two types of contacts are generally intermixed or alternatingly arranged in two opposing rows. The first type of contacts are arranged at a predetermined pitch, such as 100 mils, between the first type of contacts. The second type of contacts are also arranged at a predetermined pitch, such as 100 mils, between the second type of contacts such that there is a 50 mils pitch between the adjacent first and second contacts. One such connector is described in copending patent application Ser. No. 07/287,765, filed Dec. 21, 1988, now U.S. Pat. No. 4,934,961, entitled "Bi-Level Card Edge Connector And Method of Making The Same" by Piorunneck et al. which is assigned to the same assignee as herein and which is incorporated by reference in its entirety hereby.

U.S. Pat. No. 4,045,114 to Dechelette discloses a two part housing for an electrical connector that are bonded together to secure the contacts in their required positions. U.S. Pat. No. 4,842,538 to Noschese disclosed a card edge connector having a body shell and follower with bi-level contacts therebetween. U.S. Pat. No. 4,179,177 to Lapraik discloses a card edge connector with an outer housing and inner housing. U.S. Pat. No. 4,298,237 to Griffith et al. discloses a card edge connector having contacts at three levels aligned in columns.

However, even thought the art is replete with many different types of connectors, a problem still exists with providing a card edge connector with contact spacing at a sufficiently close and dense an arrangement to allow for faster communication between mother and daughter printed circuit boards such as with the use of more numerous contacts and yet still be suitably sized for practical applications such as in relatively small desktop computers. One problem in this regard is that prior art connectors have been only 8, 16 and 32 bit connectors. Whereas higher bit connectors, such as 128 or 256 bit or higher, could obviously transmit signals at a higher rate of speed than old connectors. However, one major problem with connectors having closely spaced contacts is the problem of cross-talk and induction between the contacts due to electromagnetic forces. A further problem exists in that faster signals have larger electrical spikes which produce stronger electromagnetic impulses. In addition, another problem with connectors is that the contacts must provide a relatively short or direct path between the daughter board and mother board to prevent propagation delays and, the signal sent through the contacts must be impedance matched to prevent reflection waves.

It is therefore an objective of the present invention to provide a new and improved connector and method of manufacturing the same that can overcome the above problems in the prior art as well as provide additional features and advantages.

SUMMARY OF THE INVENTION

The foregoing problems are overcome and other advantages are provided by a bi-level card edge connector having a plurality of closely spaced contacts.

In accordance with one embodiment of the present invention, an electrical connector is provided for mechanically and electrically connecting a mother printed circuit board and a removable daughter printed circuit board of the edge card type. The connector has a first housing, a plurality of a first type of contacts, a plurality of a second type of contacts and a contact separator. The first housing is comprised of an electrically insulating material and has a top surface with a slot for receiving a portion of a daughter printed circuit board and at least two rows of contact chambers on opposite sides of the slot. The first type of contacts are positioned in at least some of the contact chambers with the first type of contacts having a relatively tall height in the contact chambers. The second type of contacts are positioned in at least some of the same contact chambers as the first type of contacts and have a relatively short height in the contact chambers. The contact separator is located, at least partially, inside the contact chambers between portions of the first and second types of contacts located in the same contact chambers.

In accordance with another embodiment of the present invention, an electrical connector is provided for mechanically and electrically connecting a mother printed circuit board and a removable daughter printed circuit board of the edge card type. The connector comprises a housing, a plurality of a first type of contacts, and a plurality of a second type of contacts. The housing has a first housing member and a second housing member. The first housing member is comprised of an electrically insulating material and has a top surface with a first slot, a first series of contact chambers communicating with the first slot, and a bottom aperture communicating with the first slot. The second housing member is comprised of an electrically insulating material and has a second slot and a second series of contact chambers communicating with the second slot. The second housing member is, at least partially, positioned in the first housing member bottom aperture with the first slot aligned with the second slot for receiving a portion of a daughter printed circuit board therein. The first type of contacts are positioned in at least some of the first series of contact chambers and have a relatively tall height therein. The second type of contacts are positioned in at least some of the second series of contact chambers and have a relatively short height relative to the first type of contacts.

In accordance with one method of the present invention a method is provided of manufacturing an electrical connector for mechanically and electrically connecting a mother printed circuit board and a removable daughter printed circuit board of the edge card type. The method comprises the steps of providing a first housing being comprised of a dielectric material and having a top surface with a slot for receiving a portion of a daughter printed circuit board and a plurality of contact chambers communicating with the slot; inserting and mounting a plurality of a first type of contacts in the contact chambers, the first type of contacts having a relatively tall height in the contact chambers; inserting and mounting a plurality of a second type of contact in the contact chambers, the second type of contacts having a relatively short height in the contact chambers and being located in at least some of the same contact chambers as the first type of contacts; and inserting a separating member into the first housing between portions of the first and second types of contacts.

In accordance with another method of the invention; a method of manufacturing an electrical connector for mechanically and electrically connecting a mother printed circuit board and a removable daughter printed circuit board of the edge card type is provided. The method comprises the steps of providing a first housing being comprised of a dielectric material, the first housing having a top surface with a first slot for receiving a portion of the daughter printed circuit board, a plurality of first contact chambers communicating with the first slot, and a bottom aperture; inserting and mounting a plurality of a first type of contacts in the first contact chambers, the first type of contacts having a relatively tall height in the first contact chambers; providing a second housing being comprised of a dielectric material and having a second slot and a plurality of second contact chambers communicating with the second slot; inserting and mounting a plurality of a second type of contacts in the second contact chambers, the second type of contacts having a relatively short height relative to the first type of contacts; and inserting the second housing, at least partially, into the first housing bottom aperture with the first slot being aligned with the second slot.

In accordance with another embodiment of the invention an electrical connector assembly is provided for mechanically and electrically connecting a mother printed circuit board and a removable daughter printed circuit board of the edge card type. The assembly comprises a first signal section and a second power section. The first signal section has a first elongate housing of dielectric material with a top surface having a first slot for receiving a first portion of a daughter printed circuit board and a first plurality of spring contacts extending into the first slot with the first housing having a keyed end portion. The second power section has a second housing of dielectric material with a top surface having a second slot for receiving a second portion of a daughter printed circuit board and a second plurality of spring contacts extending into the second slot. The second housing has a keyed end portion such that the first and second sections can be connected to each other at their end portions.

DETAILED DESCRIPTION OF THE INVENTION

Figure 1:
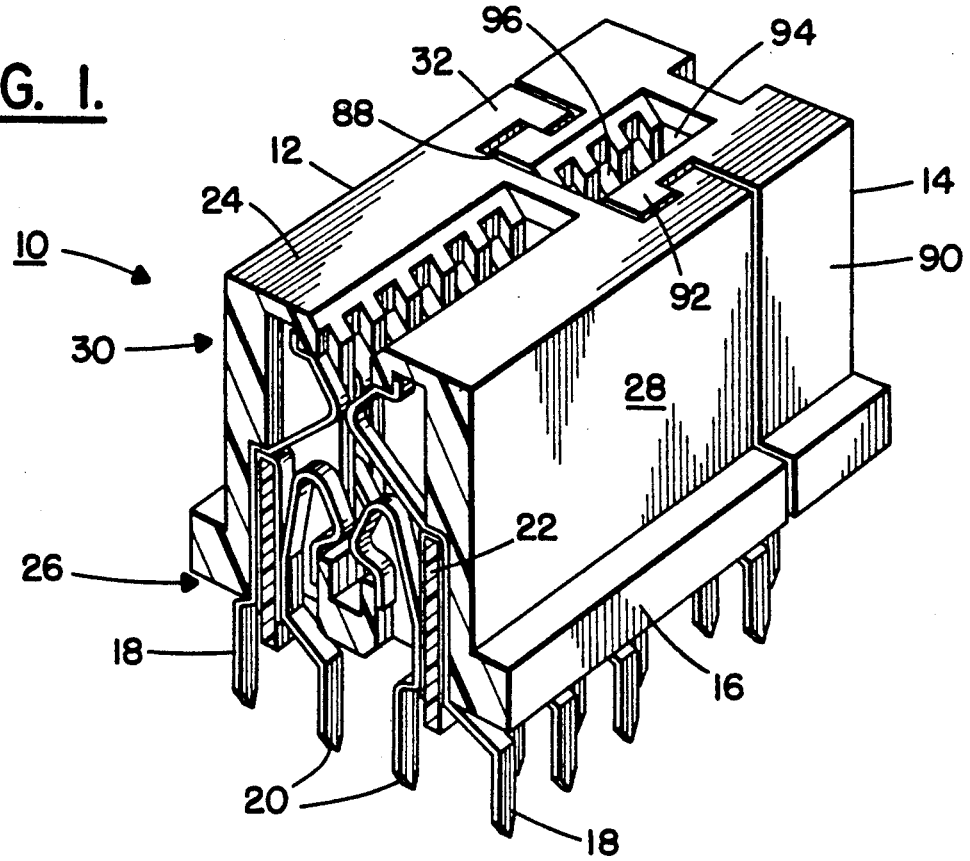
FIG. 1 is a cut away partial perspective view of a high density bi-level card edge connector incorporating features of the present invention.

Referring to FIG. 1, there is shown a cut away partial perspective view of a card edge connector 10 incorporating features of the present invention. Although the present invention is being described with reference to the embodiments shown in the drawings, it should be understood that the present invention can be embodied in many different alternate embodiments with any suitable size, shape, configuration or type of elements.

Figure 3:
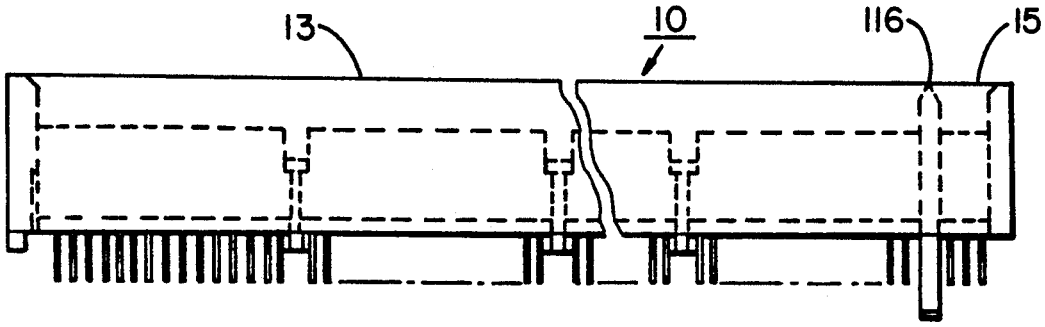
FIG. 3 is a plan side view of a connector incorporating features of the present invention.

The connector 10 shown in FIG. 1 generally comprises a signal module 12 and a power module 14. However, in an alternate embodiment of the invention the power module 14 need not be provided. In addition, the signal module 12 need not have a keyed end for mating with the power module 14 as shown in FIG. 1, but rather, may be provided as a singular form of connector as shown in FIG. 3. In the embodiment shown in FIG. 1, the signal module 12 is generally comprised of a housing 16, a plurality of an upper or first type of electrical contacts 18, a plurality of a lower or second type of electrical contacts 20, and a contact separator 22. The housing 16 is generally comprised of an electrically insulating dielectric material and has a general elongate length with a top 24, a bottom 26, two sides 28 and 30, and two ends 32 (only one of the ends is shown in FIG. 1).

Figure 2:
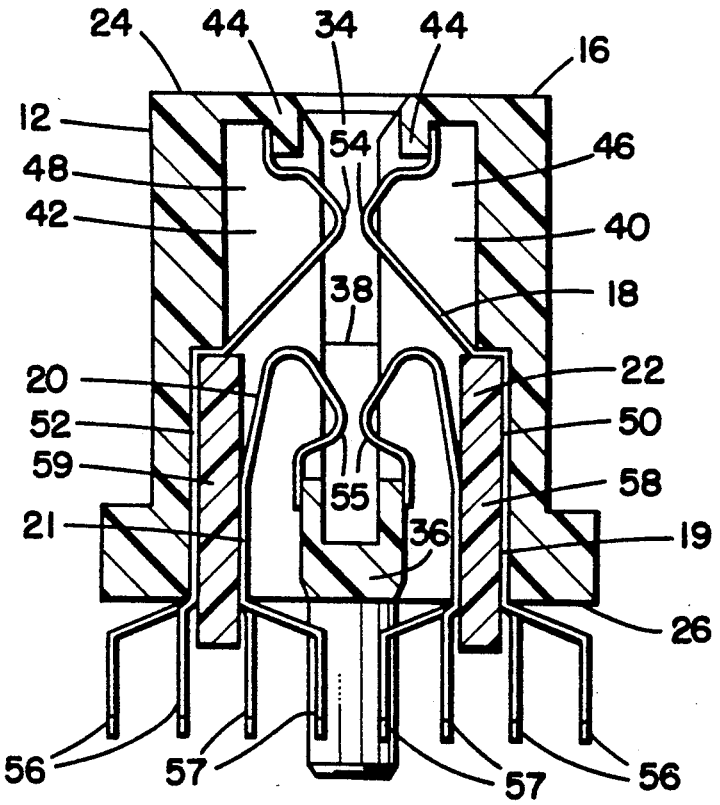
FIG. 2 is a cross sectional view of the connector shown in FIG. 1.

The housing 16 is a general rectangular or boxed shape member and has an extended length largely determined by the number of contacts to be supported therein. The majority of the bulk of the housing 16 is essentially comprised of the parallel sidewalls 28 and 30 extending the entire length of the housing 16. The end walls 32 are generally formed integrally at the ends of the sides walls 28 and 30 with sufficient thickness to add rigidity to the housing 16. Referring also to FIG. 2, a cross sectional view of the signal module 12 is shown. The housing 16 generally comprises a slot 34 extending into the housing from the top 24. The slot 34 extends down into the housing 16 along substantially its entire height and is generally intended to receive a portion of a daughter printed circuit board. In the embodiment shown, the housing 16 also has a card stop portion 36 located at the bottom of the slot 34 extending between the housing end walls 32 and separating walls 46 and 48 on opposite sides of the housing 16. The card stop portion 36 is generally intended to limit the farthest most depth of insertion of a daughter board and, in the embodiment shown, also acts as a prestress for the lower or second type of contacts 20. The housing 16 may also comprise intermediate walls (not shown) between the two side walls 28 and 30 that add rigidity to the housing 16 and also act as a polarizing means to form multiple slots 34 in the housing 16 as is known in the art. In the embodiment shown, the housing 16 also comprises suitable bi-level keying projections 38 for positioning different types of daughter boards at different levels in the housing 16 when inserted such as disclosed in copending patent application Ser. No. 07/287,765, now U.S. Pat. No. 4,934,961. Located in the interior of the housing 16 and communicating with the slot 34 are two rows of contact chambers 40 and 42 on opposite sides of the slot 34. Although contacts chambers are described with reference to the embodiments shown, it should be understood that any suitable means may be provided to keep adjacent contacts separated from each other. Located at the top 24 of the housing and extending down into the contact chambers 40 and 42 are prestress portions 44 for prestressing the first type of contacts 18. Located between and at least partially defining adjacent contact chambers are separating walls 46 and 48 of the housing 16 which aid in keeping contacts in one contact chamber from contacting contacts in an adjacent contact chamber. Passing perpendicular to and communicating with the contact chambers 40 and 42 are separator slots 50 and 52 which extend into the housing 16 from the bottom 26. The separator slots 50 and 52 are generally rectangular shaped, but may be slightly tapered towards their tops. In the embodiment shown, the separator slots 50 and 52 transverse substantially the entire length of the housing 16. However, in an alternate embodiment each one of the separator slots 50 and 52 may be comprised of multiple individual and separate slots. The separator slots 50 and 52 are generally intended to receive the separator 12 as will be further described below.

As mentioned above, the signal module 12 has two types of contacts; upper contacts 18 and lower contacts 20. The contacts 18 and 20 are generally made of an electrically conductive material and have daughter board contact portions 54 and 55 and mother board contact portions 56 and 57; respectively. The upper contacts 18 have their daughter board contact portions 54 located in a position nearer to the top of the slot 34 than the lower contacts' daughter board contact portions 55. In the embodiment shown, both the upper and lower contacts 18 and 20 are spring contacts with intermediate portions 19 and 21 fixedly mounted in the housing 16 with the aid of suitable barbs or the like (not shown). The daughter board contact portions 54 and 55 project from the contact chambers 40 and 42 into the card receiving slot 34 and are intended to be at least partially pushed away from the slot 34 by an inserted daughter board and make contact with conductive traces on the daughter board. In the embodiment shown, the mother board contact portions 56 and 57 are provided as solder tails. However, any suitable means of electrically connecting the contacts 18 and 20 to a mother board may be provided including surface mounting. As shown in this embodiment, each upper contact 18 faces another upper contact in an opposite contact chamber. Also in this embodiment, each lower contact 20 faces another lower contact in an opposite contact chamber. However, it should be understood that not every upper and lower contact need face an opposite upper and lower contact. In the embodiment shown, the upper and lower contacts 18 and 20 are both positioned in the same contact chambers. Thus, for each contact chamber in the two rows 40 and 42 two contacts are housed therein; a lower contact 20 and an upper contact 18. However, it should be understood that not every contact chamber 40 and 42 need have both upper and lower contacts in them.

As can be seen in FIGS. 1 and 2, the separator 22, in the embodiment shown, is a single member made of suitable dielectric material and has a first side 58, a second side 59, two end portions (not shown) connecting the first and second sides 58 and 59 and forming a generally open interior. However, in an alternate embodiment of the invention, the separator 22 may be provided as two or more separate members. The sides 58 and 59 of the separator 22 are substantially the same cross-sectional size and shape of the separator slots 50 and 52. In addition, the separator 22 may include suitable means to lock the separator into place in the slots 50 and 52 and may also be suitably shaped to act as a locking wedge when inserted into the slots 50 and 52.

The housing and separator configuration shown in FIGS. 1 and 2 is generally provided to perform three functions. First, it allows for relatively easy insertion of both the upper and lower contacts 18 and 20 into the housing 16. Second, it provides an additional means of retaining the contacts 18 and 20 in the housing 16. Third, it helps to keep the upper and lower contacts that are in the same contact chambers electrically isolated from each other.

Generally, the method of making the signal module 12 shown in FIGS. 1 and 2 comprises first inserting the upper contacts 18 into the housing 16. Then, the lower contacts 20 are inserted into the housing 16. Then, the separator 22 is inserted and fixed in the separator slots 50 and 52 between the upper and lower contacts. In a preferred embodiment the separator sides 58 and 59 have a wedge shaped cross-section and are press-fit into the separator slots 50 and 52. However, any suitable means can be used to fix the separator 22 to the housing 16.

Figure 2A:
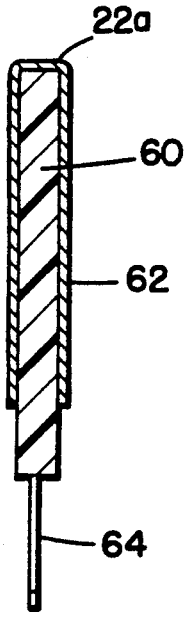
FIG. 2*a* is a cross sectional view of a grounding contact separator for use with the contacts and outer housing shown in FIG. 2.

Referring also to FIG. 2A, there is shown an alternate embodiment of a separator member **22*a*. In the embodiment shown, the separator member 22*a* is comprised of an electrically conductive member 60 having a coating of dielectric material 62 and a plurality of solder tails 64 extending from a bottom thereof. In addition to keeping the upper and lower contacts 18 an 20 electrically isolated from each other in the same contact chambers, the separator 22*a* can also be connected to a ground in a mother printed circuit board via its solder tails 64. Thus, although electrically isolated from the contacts 18 and 20 because of the dielectric cover 62, the electrically conductive member member 60 can intercept, at least partially, electromagnetic impulses generated in the contacts 18 and 20** by the flow of electricity therethrough and transmit the intercepted electromagnetic impulses to the ground in the mother printed circuit board to thereby prevent cross-talk between contacts.

Figure 4:
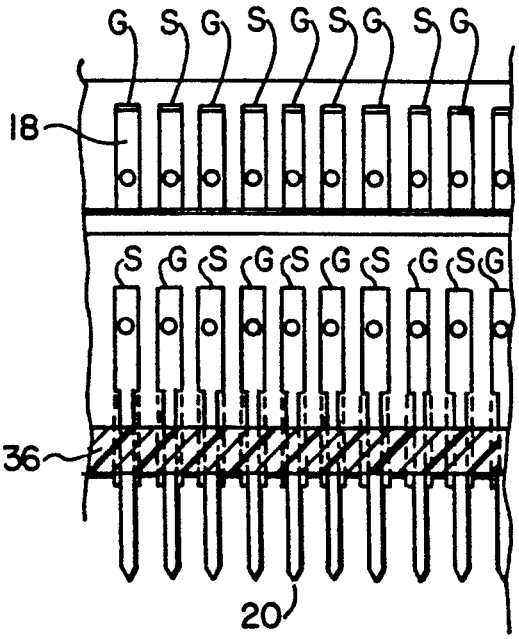
FIG. 4 is a partial cross-sectional view of the signal module of the connector shown in FIG. 2 taken from inside the card receiving slot.

The high density bi-level card edge connector described above is generally intended for high speed applications. However, it can obviously be used for normal speed applications also. Unlike the ordinary bi-level connectors known in the art, wherein each contact chamber has only one contact and, upper and lower contacts are alternatingly arranged on both sides of the housing, the present invention nearly doubles the number of contacts in its housing in substantially the same space as with other connectors known in the art. Thus, the present invention can be used to increase the number of signals being sent through the signal module 12 at the same time due to the increased density or number of contacts. In addition, rather than using the increased density of contacts to send more signals at the same time along different paths, the increased number of contacts can be used for grounding purposes with every other pair of opposing lower contacts 20 and every other pair of opposing upper contacts 18 being connected to a ground in the mother printed circuit board. The grounded opposing pairs of upper and lower contacts 18 and 20 could be alternatingly arranged in the contact chambers such that only about half of the contacts would be signal contacts and the other contacts would be grounds. Thus, as shown in FIG. 4, the signal contacts S would have an alternating arrangement, but with ground contacts G located above and on both sides of the lower signal contacts S and, below and on both sides of the upper signal contacts S.

As described above, high speed signals generate a relatively high spike of electromagnetic impulse. The faster the signal the greater the electromagnetic impulse. The greater the electromagnetic impulse, the greater the possibility of magnetic forces from one contact generating a cross-talk or interference signal in an adjacent or proximate contact. By use of the present invention, each of the signal contacts is substantially surrounded on two sides and either its top or bottom by grounding contacts that intercept electromagnetic impulses and substantially prevent the impulses from interfering with other signal contacts. Thus, substantially faster signals can be sent through the signal module 12 without significant increase in cross-talk between signal contacts. Since faster signals can be sent, more signals can be sent in a given period of time than as in old connectors thereby allowing faster communication between the mother and daughter printed circuit boards.

The power module 14, in the embodiment shown in FIGS. 1 and 2, is similar to the signal module 12 with various different exceptions. First, the end 32 of the signal module housing 16 has a T-shaped aperture 88. The power module 14 has a housing 90 with a T-shaped end 92 suitably sized and shaped to be received in the signal module T-shaped aperture 88. This use of the mating ends of the two modules 12 and 14 locks the modules 12 and 14 together in at least two directions and suitable additional means (not shown) may also be provided to lock the power module 14 to the signal module 12 in all directions. FIG. 3 shows a side view of an alternate embodiment of the invention wherein the connector 10 has an integrally formed signal section 13 and power section 15. Referring back to FIGS. 1 and 2, the housing 90 has a card receiving slot 94 extending thereinto from its top and suitable contact chambers 96 on both sides of the slot 94. In the embodiment shown, each contact chamber 96 has only one contact therein with upper contacts 18 in the middle contact chambers 96 and lower contacts 20 in the end contact chambers 96 on both sides of the upper contacts 18. The power module 14 and the reason for this preferred arrangement of contacts will be further described below.

Figure 6:
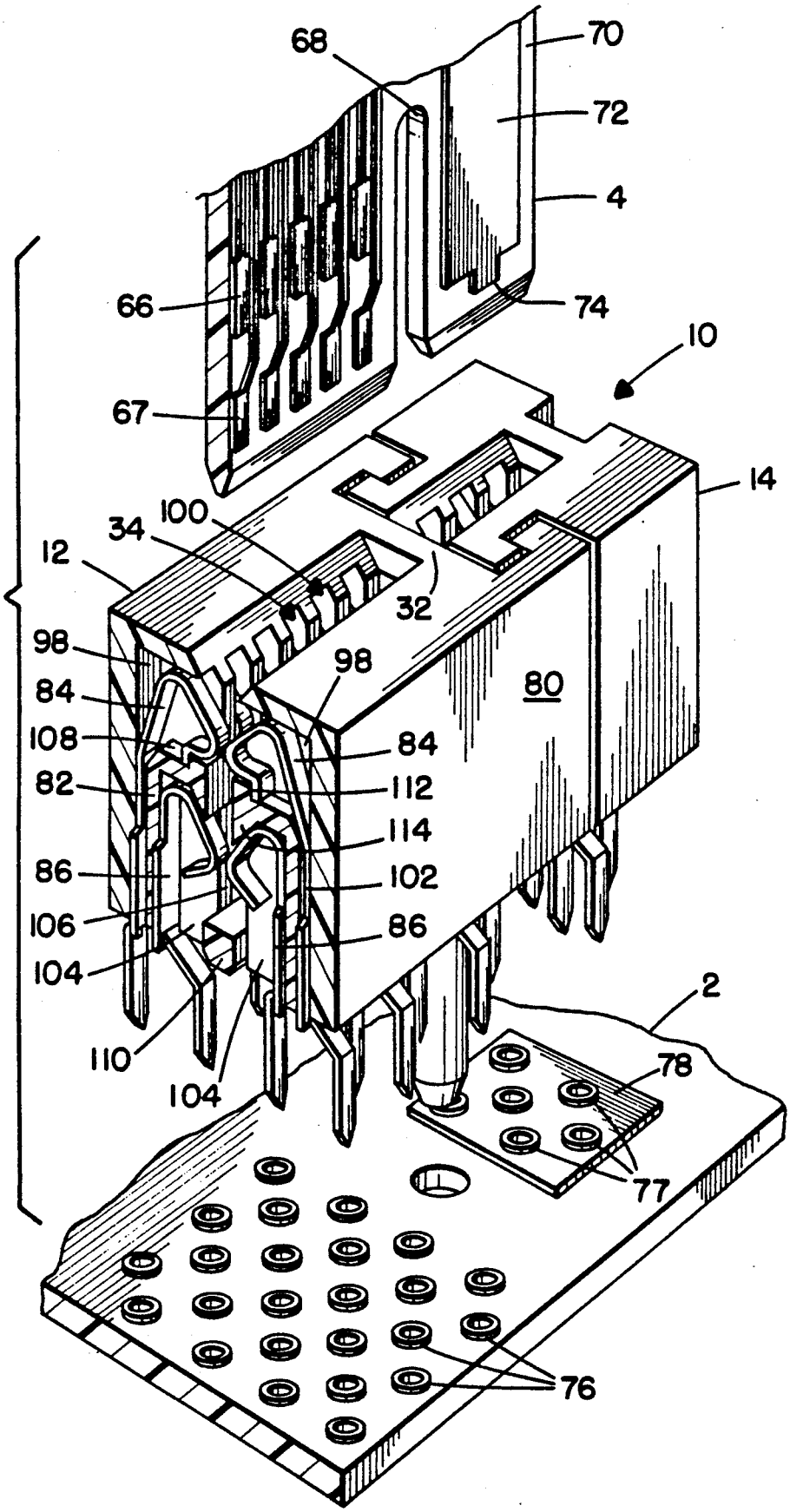
FIG. 6 is a partial cut away perspective view of a connector incorporating features of the present invention with a mother printed circuit board and daughter printed circuit board.

Referring now to FIG. 6, an exploded partial perspective view of a mother board 2, a daughter board 4, and an alternate embodiment of the connector 10 is shown. The daughter board 4 has two rows of contact traces on each side; an upper row 66 and a lower row 67. This portion of the daughter board 4 is generally intended to be inserted into the card edge receiving slot 34 of the signal module 12. The upper row of traces 66 are aligned with the lower row of traces 67 on the card shown, but the present invention can also be used with daughter boards that do not have their upper and lower rows of traces aligned as will further be described below. The daughter board 4 also has a recess 68 to accommodate the end wall 32 of the signal module 12 when the daughter board is inserted into the connector 10. Located at the end of the daughter board 4 is a power section 70 having power contact strips or traces 72 on each side. In the embodiment shown, the power contact traces 72 each have a downwardly extending portion or tab 74.

The mother printed circuit board 2 generally includes a first plurality of apertures 76 intended to receive the solder tails 56 and 57 of the contacts in the signal module 12. The mother board 2 also has a second plurality of apertures 77 intended to receive the solder tails 56 and 57 of the contacts in the power module 14. A suitable electrically conductive plate 78 is provided on the mother board 92 interconnecting the second plurality of apertures 77. However, it should be understood that the present invention need not include a power module or other means to transmit large amounts of power from the mother board 2 to the daughter board 4.

Figure 7:
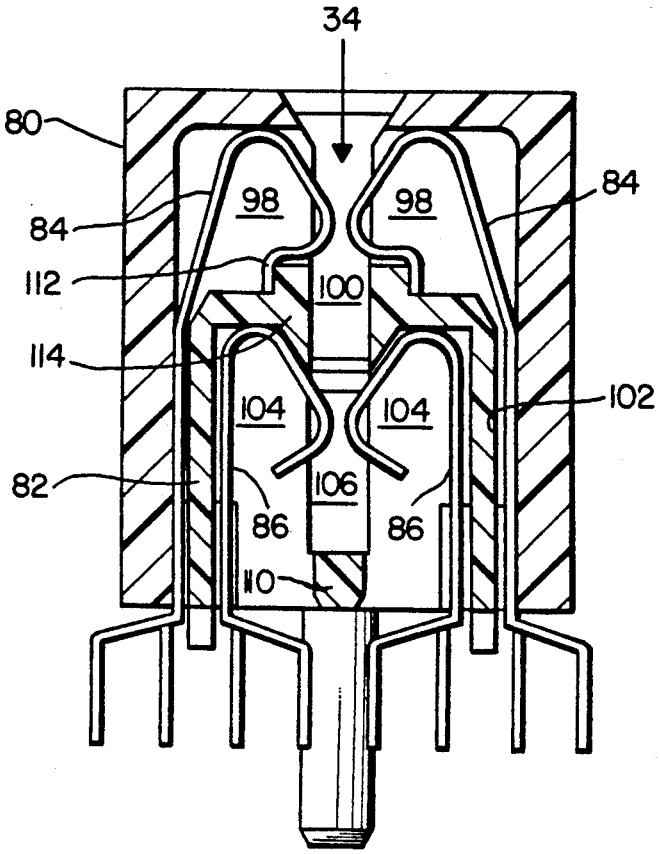
FIG. 7 is a cross sectional view of the connector shown in FIG. 6.

Referring also to FIG. 7 a cross-sectional view of the connector shown in FIG. 6 is shown. In the embodiment shown, the signal module 12 is generally comprised of an outer housing 80, an inner housing 82, an upper series of contacts 84 on both sides of the module and a lower series of contacts 86 on both sides of the module. Both the inner and outer housings are comprised of dielectric material. The outer housing 80 generally comprises a first series of contact chambers 98 on opposite sides of the housing 80, a center card receiving slot 100, and a cavity 102 extending into the outer housing 80 from its bottom. The cavity 102, in the embodiment shown, communicates with both the two rows of contact chambers 98 and the outer housing slot 100.

The inner housing 82 generally comprises a second series of contact chambers 104, a center card receiving slot 106 that passes through a top 108 of the inner housing, and a card edge stop 110 located at the bottom of the slot 106. The top 108 also comprises, in the embodiment shown, a top contact prestress portion 112 and a bottom contact prestress portion 114 on both sides of the slot 106. In the embodiment shown, the outer profile of the inner housing 82 is substantially identical to the shape of the outer housing cavity 102 such that the inner housing 82 can be inserted into the cavity 102 and fixedly connected to the outer housing 80 by suitable means (not shown). When the inner housing 82 is inserted into the outer housing 80, the inner housing slot 106 aligns with the outer housing slot 100 to form the module card receiving slot 34.

When the signal module 12 is assembled, as shown in FIG. 7, the upper contacts 84 are at least partially housed in the outer housing contact chambers 98 and are at least partially prestressed by the top contact prestress portion 112. The lower contacts are at least partially housed in the inner housing contact chambers 104 and are at least partially prestressed by the bottom contact prestress portion 114. Both the upper and lower contacts 84 and 86 have suitable barbs or the like to fixedly connect them to the outer and inner housings, respectively. In a preferred embodiment the upper and lower contacts 84 and 86 are aligned with each other. However, as further described below, this is not a requirement of the present invention.

The assembly of the signal module 12 shown in FIG. 7 can be accomplished in various alternating steps, but in a preferred method of manufacturing the signal module 12 the upper contacts 84 are first inserted into and mounted to the outer housing 80 inside the outer housing contact chambers 98. Then, the lower contacts 86 are inserted into and mounted to the inner housing 82 inside the inner housing contact chambers 104. Then, the inner housing 82 is inserted into the cavity 102 of the outer housing 80 and fixedly mounted therein. The inner housing 82 suitably insulates the lower contacts 86 from the upper contacts 84 and also wedges the intermediate portions of the upper contacts 84 against the outer housing to further secure the upper contacts 84 in the module 12.

Figure 5:
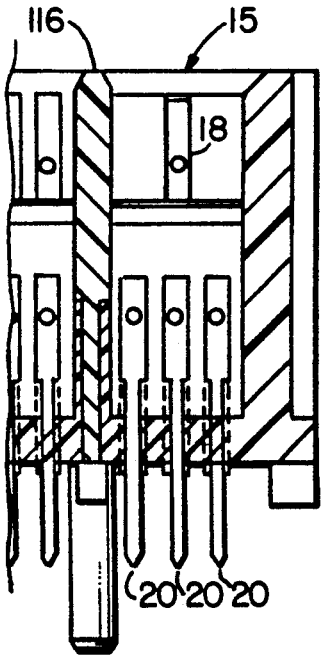
FIG. 5 is a partial cross-sectional view of the power section of the connector shown in FIG. 3 taken from inside the card receiving slot.

In the embodiment shown in FIG. 6, the connector 10 has a power module 14. However, as noted above, a power module need not be provided with the connector. The power module 14 is generally provided to supply electricity from the mother board 2 to the daughter board 4. The power module 14 shown in the drawings is particularly adapted to allow for hot mating or power active connection of the daughter board 4 into the connector 10; i.e.: insertion of the daughter board 4 into the power module 14 when the contacts in the power module are connected to a supply of electricity from the mother board 2. A problem with attempting to make a connection of a daughter board 4 to a connector actively connected to a power source in the prior art was that arcing or jumping of electricity from the contacts in the connectors to the daughter board would result in degradation or distraction of the contact surfaces due to pitting and burning from the high temperatures generated by arcing. Due to the small size of the contacts and contact surfaces, the pitting and burning resulted in the prevention of electrical connection between the contacts in the connectors and the daughter board. The present invention can include a power module as described above or unitary connector having a power section that overcomes the problem caused by pitting and burning. Although the power module 14 does not eliminate arcing between the contacts in the power module 14 and the contact strip 72, the bi-level configuration of the contacts 18 and 20 and the interconnection of the contacts 18 and 20 at the conductive plate 78 on the mother board 2, which allows the contacts 18 and 20 to have the same electric potential, combine functions with the power strip 72 and its tab 74 to force the arcing to occur between the upper contacts 18 and the tab 74. This results in the lower contacts 20 and the majority of the power strip 72 not being affected by arcing because of interconnection of the upper and lower contacts 18 and 20 at conductive plate 78 which, once electrical connection is made between the upper contacts 18 and the power strip 72, results in all of the contacts 18 and 20 in the power module 14 having the same electric potential as the power strip 72 and thus no arcing occurs between the lower contacts 20 and the power strip 72 as the daughter board is further inserted. Hence, the power module of the present invention allows for repeated connection and disconnection of a daughter board to a card edge connector when power to the mother board is active. Referring to FIG. 5, a schematic cross-sectional view of the power section 15 of the connector of FIG. 3 is shown. In the embodiment shown, the power section is integrally formed with the power section 13, but a section separator 116 has been inserted into the card receiving slot to separate the contacts of the signal section from the contacts of the power section. In the embodiment shown, the power section 15 has one middle upper contact 18 on each side and three lower contacts 20 on each side. However, any suitable arrangement can be provided.

Figure 8:
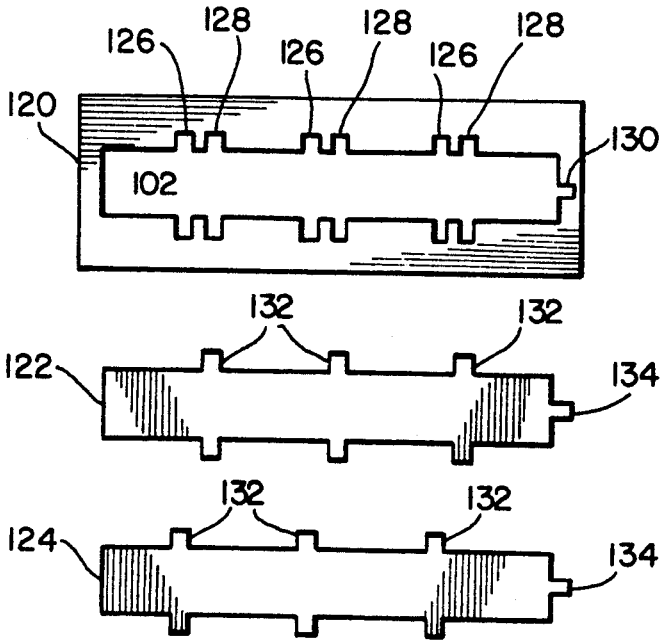
FIG. 8 are schematic bottom views of an outer housing and two different types of inner housings.
Figure 8A:
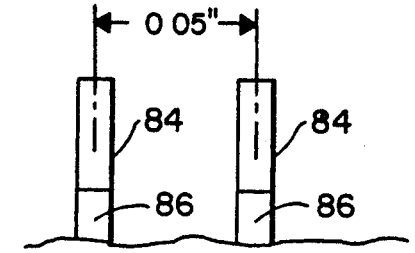
FIG. 8*a* is a schematic view of the pitch of the contacts for a connector having the outer housing and the first inner housing shown in FIG. 8.
Figure 8B:
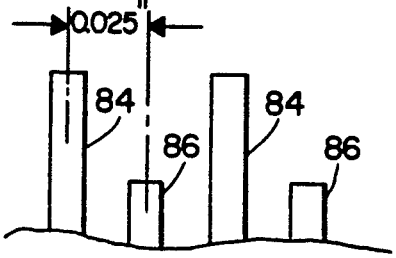
FIG. 8*b* is a schematic view of the pitch of the contacts for a connector having the outer housing and second inner housing shown in FIG. 8.

Referring now to FIGS. 8, 8A and 8B, another feature of the present invention will be described. FIG. 8 generally shows schematic bottom views of an outer housing 120, a first inner housing 122, and a second inner housing 124. The outer housing 120 is similar to the outer housing 80 shown in FIG. 6, but has two series of keying slots 126 and 128, as well as an end keying slot 130. The keying slots 126, 128 and 130 are generally provided to ensure proper insertion and alignment of the inner housings in the bottom aperture 102. The outer housing 120 is adapted to receive either the first inner housing 122 or the second inner housing 124. The first inner housing 122 has suitable keying extensions 132 and an end keying extension 134. The keying extensions 132 are suitably positioned on the first inner housing 122 such that when the first inner housing 122 is inserted into the outer housing bottom aperture 102, they are received in the second series of keying slots 128 and position the first inner housing 122 at a precise longitudinal position relative to the outer housing 120. With the first inner housing 122 suitably positioned and mounted to the outer housing 120, the relationship of the upper contacts 84 (see FIG. 6) located in the outer housing 120 relative to the lower contacts 86 (see FIG. 6) located in the first inner housing 122 can be an alignment between the contacts as schematically shown in FIG. 8A with a pitch of about 0.05 inch between pairs of contacts, both upper and lower. The end keying extension 134 is merely provided for polarization means to insure that the first inner housing is not accidentally inserted into the outer housing 102 in a 180 degrees opposite orientation.

The second inner housing 124 is similar to the first inner housing 122, except for the location of its keying extensions 132 and the longitudinal location of its lower contacts 86 (see FIG. 6) in the second inner housing 124. When the second inner housing 124 is inserted into the outer housing bottom aperture 102, the keying extensions 132 are received in the first series of keying slots 126 and position the second inner housing 124 at a precise longitudinal position in the outer housing 120. With the second inner housing 124 suitably positioned and mounted to the outer housing 120, the relationship of the upper contacts, located in the outer housing 120, relative to the lower contacts, located in the second inner housing 124, can be offset such as schematically shown in FIG. 8B. In the embodiment shown, the pitch between upper and lower contacts is 0.025 inch; the upper contacts having a pitch of 0.05 inch in the outer housing 120, the lower contacts having a pitch of 0.05 inch in the inner housing 124, and the lower contacts being offset from the upper contacts. Thus, where prior card edge connectors were limited to a predetermined pitch between contacts of about 0.05 inch due to manufacturing tolerances and material strengths, the present invention can significantly reduce the pitch between contacts in a card edge connector. Although the example of a pitch of 0.025 inch is disclosed above, it should be understood that the present invention can have any suitable pitch between upper and lower contacts ranging from no pitch at alignment to as low as between 0.0001 inch to over 0.025 inch, or as tolerances allow. Although two different inner housings are described above to produce two different types of contact pitches, it should also be understood that the present invention can be employed with only one type of inner housing wherein the outer housing has suitable means, such as the two series of keying slots 126 and 128, for receiving the single inner housing at two different possible positions in the outer housing bottom aperture. In addition, the present invention can include three or more housings or any suitable combination of housings and separators.

Let it be understood that the the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector for mechanically and electrically connecting a mother printed circuit board and a removable daughter printed circuit board of the edge card type, the connector comprising:

a first housing being comprised of an electrically insulating material and having a top surface with a slot for receiving a portion of a daughter printed circuit board and at least two rows of contact chambers on opposite sides of said slot;

a plurality of a first type of electrically conductive contacts positioned in at least some of said contact chambers, said first type of contacts having a relatively tall height in said contact chambers;

a plurality of a second type of electrically conductive contacts positioned in at least some of the same contact chambers as said first type of contacts, said second type of contacts having a relatively short height in said contact chambers and being spaced from said first type of contacts; and a contact separator stationarily connected to said housing and located, at least partially, inside said contact chambers between portions of said first and second types of contacts located in said same contact chambers.

2. A connector as in claim 1 wherein said contact separator is a wedge comprised of dielectric material that is wedged between portions of said first and second types of contacts in each of said same chamber.

3. A connector as in claim 2 wherein said first housing has a second slot extending transversely through at least one of said rows of contact chambers in which said wedge is located.

4. A connector as in claim 1 wherein said first housing comprises means for receiving at least a portion of a second housing.

5. A connector as in claim 4 wherein said means for receiving at least a portion of a second housing comprises a keying portion at an elongate end of said first housing.

6. A connector assembly comprising:

an electrical connector as in claim 1; and a power connector module connected to an end of said electrical connector.

7. A connector assembly as in claim 6 wherein said power connector module comprises a dielectric housing having a second slot and a plurality of spring contacts for connecting a power section of a mother printed circuit board with a power section of a daughter printed circuit board.

8. A connector assembly as in claim 6 wherein said electrical connector is disconnectably attached to said power connector module.

9. A connector as in claim 1 wherein said separator is comprised of an electrically conductive member covered by a dielectric material.

10. A connector as in claim 9 wherein said electrically conductive member has an extension portion connectable to a ground in a mother printed circuit board.

11. An electrical connector for mechanically and electrically connecting a mother printed circuit board and a removable daughter printed circuit board of the edge card type, the connector comprising:

a housing having a first housing member and a second housing member, said first housing member being comprised of an electrically insulating material and having a top surface with a first slot, a first series of contact chambers communicating with said first slot, and a bottom aperture communicating with said slot, said second housing member being comprised of an electrically insulating material and having a second slot and a second series of contact chambers communicating with said second slot, said second housing member being, at least partially, positioned in said first housing member bottom aperture with said first slot aligned with said second slot for receiving a portion of a daughter printed circuit board therein;

a plurality of a first type of electrically conductive contacts positioned in at least some of said first series of contact chambers, said first type of contacts having a relatively tall height in said first series of contact chambers; and a plurality of a second type of electrically conductive contacts positioned in at least some of said second series of contact chambers, said second type of contacts having a relatively short height relative to said first type of contacts.

12. A connector as in claim 11 wherein said first type of contacts are mounted to said first housing member.

13. A connector as in claim 11 wherein said second type of contacts are mounted to said second housing member.

14. A connector as in claim 11 wherein said second housing member substantially separates said first and second types of contacts.

15. A connector as in claim 11 wherein at least some of said second type of contacts are aligned with said first type of contacts.

16. A connector as in claim 11 wherein center axes of said second type of contacts are linearly offset from center axes of said first type of contacts from a range of about 0.0001 to about 0.025 inch.

17. A connector as in claim 11 wherein said first housing member comprises means for receiving said second housing member in said aperture at a variety of positions to thereby configure the spacing between center axes of said first and second types of contacts.

18. A connector as in claim 11 wherein said first housing member has means for prestressing said first type of contacts.

19. A connector as in claim 11 wherein said second housing member has means for prestressing said first type of contacts.

20. A connector as in claim 11 further comprising means for interlocking said first housing member to said second housing member.

21. A connector assembly comprising:

an electrical connector as in claim 11; and a power connector module connected to an end of said electrical connector.

22. A method of manufacturing an electrical connector for mechanically and electrically connecting a mother printed circuit board and a removable daughter printed circuit board of the edge card type, the method comprising the steps of:

providing a first housing being comprised of a dielectric material and having a top surface with a slot for receiving a portion of a daughter printed circuit board and a plurality of contact chambers communicating with said slot;

inserting and mounting a plurality of a first type of contact in said contact chambers, said first type of contact having a relatively tall height in said contact chambers;

inserting and mounting a plurality of a second type of contact in said contact chambers, said second type of contact having a relatively short height in said contact chambers and being located in at least some of the same contact chambers as said first type of contacts and spaced therefrom; and p1 inserting and fixing a separating member into said first housing between portions of said first and second types of contacts.

23. A method of manufacturing an electrical connector for mechanically and electrically connecting a mother printed circuit board and a removable daughter printed circuit board of the edge card type, the method comprising the steps of:

providing a first housing being comprised of a dielectric material, said first housing having a top surface with a first slot for receiving a portion of a daughter printed circuit board, a plurality of first contact chambers communicating with said first slot, and a bottom aperture;

inserting and mounting a plurality of a first type of contacts in said first contact chambers, said first type of contacts having a relatively tall height in said first contact chambers;

providing a second housing being comprised of a dielectric material and having a second slot and a plurality of second contact chambers communicating with said second slot;

inserting and mounting a plurality of a second type of contacts in said second contact chambers, said second type of contacts having a relatively short height relative to said first type of contacts; and inserting said second housing, at least partially, into said first housing bottom aperture with said first slot being aligned with said second slot.

24. An electrical connector assembly for mechanically and electrically connecting a mother printed circuit board and a removable daughter printed circuit board of the edge card type, the assembly comprising:

a first signal section having a first elongate housing of dielectric material with a top surface having a first slot for receiving a first portion of a daughter printed circuit board and a first plurality of spring contacts extending into said first slot, said first housing having a keyed end portion; and a second power section having a second housing of dielectric material with a top surface having a second slot for receiving a second portion of a daughter printed circuit board and a second plurality of spring contacts extending into said second slot, said second housing having a keyed end portion such that said first and second sections can be connected to each other at said end portions.

* * * * *

UNITED STATES PATENT AND TRADEMARK OFFICE

CERTIFICATE OF CORRECTION

PATENT NO. : 5,024,609

DATED : 6/18/91

INVENTOR(S) : Piorunneck et al

It is certified that error appears in the above-identified patent and that said Letters Patent is hereby corrected as shown below:

On the title page item [75] Inventors: please add "Rocco J. Noschese, Wilton, connecticut" as co-inventor.

Col. 13, line 42, delete "P1".

Signed and Sealed this

Ninth Day of June, 1992

*Attest:*

DOUGLAS B. COMER

*Attesting Officer*

*Acting Commissioner of Patents and Trademarks*